US005145317A

United States Patent [19]

Brasz

[11] Patent Number: 5,145,317

[45] Date of Patent: Sep. 8, 1992

[54] CENTRIFUGAL COMPRESSOR WITH HIGH EFFICIENCY AND WIDE OPERATING RANGE

[75] Inventor: Joost J. Brasz, Fayetteville, N.Y.

[73] Assignee: Carrier Corporation, Syracuse, N.Y.

[21] Appl. No.: 739,006

[22] Filed: Aug. 1, 1991

[51] Int. Cl.[5] ..... F01D 1/06

[52] U.S. Cl. ..... 415/224.5; 415/203; 415/206; 415/207; 415/208.3; 415/208.2

[58] Field of Search ..... 415/203, 206, 207, 208.2, 415/208.3, 224.5

[56] References Cited

U.S. PATENT DOCUMENTS

| | | | |
|---|---|---|---|
| 2,291,478 | 7/1942 | LaBour | 415/203 X |
| 3,333,762 | 8/1967 | Vrana | 415/207 |
| 3,604,818 | 9/1971 | Cronstedt | 415/207 |
| 3,743,436 | 7/1973 | O'Conner | 415/207 X |
| 3,876,328 | 4/1975 | Exley | 415/208.3 |
| 3,964,837 | 6/1976 | Exley | 415/208.3 |
| 4,219,305 | 8/1980 | Mount et al. | 415/158 X |
| 4,257,733 | 3/1981 | Bandukwalla et al. | 415/158 X |
| 4,302,150 | 11/1981 | Wieland | 415/207 |
| 4,368,005 | 1/1983 | Exley et al. | 415/207 |
| 4,378,194 | 3/1983 | Bandukwalla | 415/158 X |
| 4,503,684 | 3/1985 | Mount et al. | 415/208.3 X |
| 4,527,949 | 7/1985 | Kirtland | 415/208.3 X |
| 4,576,550 | 3/1986 | Bryans | 415/208.3 |
| 4,611,969 | 9/1986 | Zinsmeyer | 415/208.3 X |
| 4,874,575 | 10/1989 | Dunn et al. | 415/206 X |

FOREIGN PATENT DOCUMENTS

| | | | |
|---|---|---|---|
| 581164 | 3/1931 | Fed. Rep. of Germany | 415/207 |
| 685814 | 1/1953 | United Kingdom | 415/207 |

*Primary Examiner*—Thomas E. Denion
*Assistant Examiner*—Todd Mattingly

[57] ABSTRACT

A pipe diffuser is used in a centrifugal compressor in such a way as to obtain high efficiency over a broad operating range. The number of channels in the pipe diffuser is limited such that the wedge angle is relatively large and therefore not susceptible to flow separation at the leading edges thereof. The vaneless space between the impeller and the leading edge circle of the diffuser is limited in its radial depth such that the flow separations are further inhibited. Finally, the impeller has a relatively high backsweep such that the absolute flow exit angle is relatively low, thereby reducing the sensitivity to lower flow conditions.

11 Claims, 5 Drawing Sheets

CENTRIFUGAL COMPRESSOR WITH HIGH EFFICIENCY AND WIDE OPERATING RANGE

BACKGROUND OF THE INVENTION

This invention relates generally to compressor apparatus and, more particularly, to a method and apparatus for compressing a fluid in a centrifugal compressor with relatively high efficiencies and over a substantial operating range.

In a centrifugal compressor, it is desirable to convert the gas kinetic energy leaving the impeller to potential energy or static pressure. This is commonly accomplished by way of a diffuser which may be of either fixed or adjustable geometry. The fixed geometry diffuser may be of the vaneless type, or it may be of the fixed vane type. An adjustable geometry diffuser may be either of the vaned or vaneless type and take the form of a throttle ring as shown in U.S. Pat. No. 4,219,305 assigned to the assignee of the present invention, a movable wall as shown in U.S. Pat. No. 4,527,949 assigned to the assignee of the present invention, or include rotatable vanes as shown in U.S. Pat. No. 4,378,194 assigned to the assignee of the present invention. Each of these various types of diffusers have peculiar operating characteristics that tend to favor or discourage their use under particular operating conditions.

Centrifugal chillers used in air conditioning systems are normally required to operate continuously between full load and part load (e.g., 10 percent capacity) conditions. At this 10% flow condition, the air conditioning system still requires a relatively high pressure ratio (i.e., from 50–80% of the full load pressure ratio) from the compressor. This requirement puts an extreme demand on the stable operating range capability of the centrifugal compressor. Therefore, to prevent early compressor surge caused by impeller stall, centrifugal compressors are typically provided with a variable inlet geometry device (i.e. inlet guide vanes). Rotatable inlet guide vanes are able to reduce the flow incidence angle at the impeller under part load conditions, thus enabling stable compressor operation at much lower capacities.

In addition to the instability which may be introduced by the particular impeller and its inlet design, the diffuser may also be cause for instability under part load conditions. Of all types of diffusers, the vaneless type generally provides the broadest operating range since it can handle a wide variation of flow angles without triggering overall compressor surge. If variable geometry, such as is discussed hereinabove, is added to such a vaneless diffuser, further stability can be obtained, but such features add substantially to the complexity and costs of a system.

Typically associated with the broader operating range of a vaneless diffuser is substantially lower efficiency levels because of the modest pressure recovery in the diffuser. The vaned diffuser, on the other hand, allows higher efficiencies but generally demonstrates a substantially smaller stable operating range. To increase this operating range, some type of variable diffuser geometry may be added to the vaned diffuser to prevent surge when operating under off-design conditions so as to thereby obtain relatively high efficiency over a broad operating range. But again, such a structure is relatively expensive.

One type of fixed geometry diffuser that has demonstrated an exceptionally higher efficiency level is that of the fixed vane or channel diffuser, which may take the form of a vane island or wedge diffuser as shown in U.S. Pat. No. 4,368,005, or a so-called pipe diffuser design as shown in U.S. Pat. No. 3,333,762. The latter was developed for efficiency improvement under transonic flow conditions occurring in high pressure ratio gas turbine compressors. Like other vaned diffuser compressors as discussed hereinabove, higher efficiencies are obtained, but they normally introduce an associated narrow stable operating range, which for the gas turbine compressor is not of concern, but when considered for centrifugal chiller application is of significant concern as discussed hereinabove.

In one instance as shown in U.S. Pat. No. 4,302,150, a pipe diffuser was used, supposedly to obtain higher efficiencies, with the associated narrow operating range being broadened by the introduction of a so-called vaneless diffuser space between the impeller outer periphery and the entrance to the diffuser. However, the increased stability of such a design is minimal and only occurs under full load operating conditions (i.e., no inlet guide vanes). Further, the larger vaneless diffuser space reduces the compressor lift capability under part load conditions. Moreover, the introduction of a relatively large vaneless space tends to move the peak efficiency closer to the surge point, an operating condition that cannot be tolerated for safe compressor operation.

In addition to the design considerations for the diffuser as discussed hereinabove, the impeller design features can also be chosen so as to generally optimize efficiency and operating range. While it is generally understood that impeller efficiency peaks when its blade exit angle $\beta_2$ approaches 45 degrees (as measured from the tangent direction), there is also a general understanding that, to a point, the operating range of a centrifugal compressor increases as the impeller blade exit angle $\beta_2$ decreases. For a given ratio between the impeller inlet relative velocity and the impeller exit relative velocity, reducing the impeller blade exit angle $\beta_2$ (i.e., increasing the backsweep) will reduce the absolute flow exit angle $\beta_2$ leaving the impeller. If this angle $\alpha_2$ decreases too far, however, the radial pressure gradients near the impeller periphery tend to cause flow separation, and the operating range thus becomes narrower. Therefore, in centrifugal refrigeration impeller practice, the impeller absolute flow exit $\alpha_2$ angle is normally chosen to be within the range of 20 and 40 degrees. Further, heretofore, it was generally understood that to reduce the impeller flow exit angle $\alpha_2$ below 20 degrees would inherently lead to flow separation and a narrowed operating range. The use of impellers with such flow exit angles have thus been avoided.

It is, therefore, an object of the present invention to provide an improved centrifugal compressor method and apparatus.

Another object of the present invention is the provision for a centrifugal compressor which demonstrates high efficiency and a broad stable operating range.

Yet another object of the present invention is the provision in a centrifugal compressor for obtaining higher efficiencies without any substantial loss in operating range.

Still another object of the present invention is the provision in a centrifugal compressor for a diffuser apparatus which is effective in use and economical to manufacture and operate.

Still another object of the present invention is the provision for a centrifugal compressor which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, a fixed vane or channel type diffuser is provided with a relatively few number of channels so as to thereby maximize the "wedge angle" therebetween. The associated impeller is, in turn, so designed that its flow exit angle is relatively small. The combination of the relatively large wedge angle with the relatively small flow exit angle allows for a relatively large angle of incidence without causing flow separation and degradation of the operating range.

By another aspect of the invention, the diffuser comprises a series of conical channels having center lines which extend substantially tangentially to the outer periphery of the impeller. The channel structure itself brings about increased efficiencies, and the tangential orientation of the channels to the impeller further enhances the efficiency characteristics of the system.

In accordance with another aspect of the invention, the impeller is so designed that its absolute flow exit angle $\alpha_2$ is maintained below 20 degrees. This is accomplished in one form by the use of backswept vanes. Flow separation that might otherwise occur is then prevented by maintaining the associated wedge angle $\alpha_2$ between the adjacent diffuser channels above 15 degrees. In this way, both high efficiency and a broad stable operating range is obtained.

By yet another aspect of the invention, the vaneless space, between the outer periphery of the impeller and the leading edge circle defined by the leading edges of the wedges, is limited in radial depth to thereby reduce the likelihood of flow separation in the vaneless space. In particular, the radial dimension is limited so as not to exceed the throat diameter of the channels.

In the drawings as hereinafter described, a preferred embodiment is depicted; however, various other modifications and alternate constructions can be made thereto without departing from the true spirit and scope of the invention.

THE DESCRIPTION OF THE PREFERRED EMBODIMENT

Figure 1:
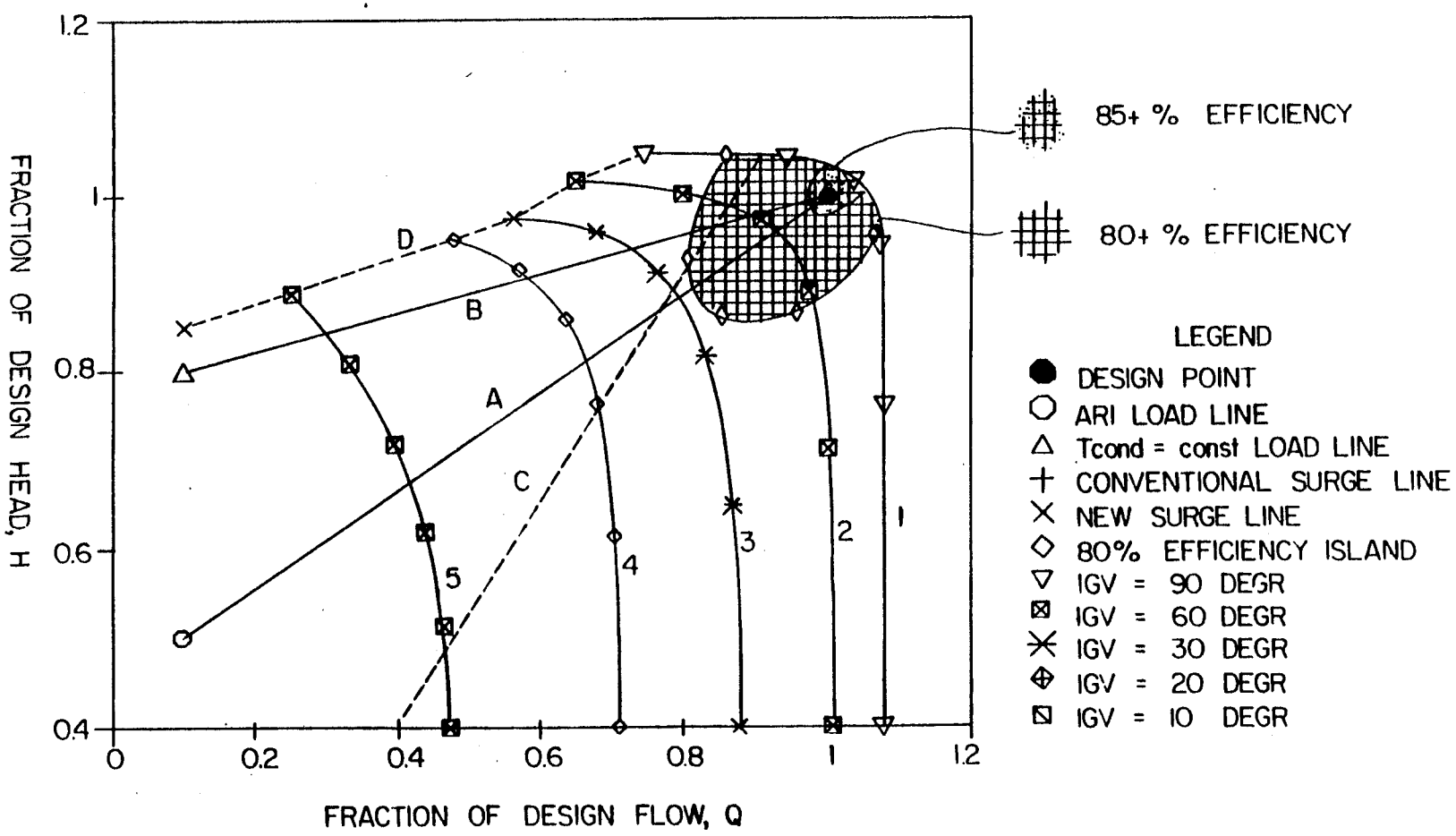
FIG. 1 is a graphic illustration of a performance map for a fixed speed centrifugal compressor with variable inlet guide vane geometry as compared with that for the fixed diffuser geometry of the present invention.

Referring now to FIG. 1, there is shown a plurality of performance map curves representative of various configurations of centrifugal compressors with different inlet guide vane positions as compared with the fixed diffuser geometry of the present invention. In order to understand the significance of the present invention, it is desirable to consider some of the performance characteristics of existing systems.

Centrifugal compressors with vaned diffusers (such as diffusers using airfoil vanes, single thickness vanes, vane islands or conical pipes) have higher efficiencies than compressors with vaneless diffusers and are therefore very attractive, but they also have a smaller stable operating range and therefore need expensive and complicated variable diffuser geometry devices and control schemes to prevent surge under off-design conditions. Considering the definition of the stable operating range as:

$$\text{stable operating range} = \frac{\text{choke mass flow} - \text{surge mass flow}}{\text{choke mass flow}}$$

wherein choke mass flow = the maximum flow when the flow reaches sonic velocity at the throat (represented by curve 1)

surge mass flow = minimum or surge flow representing the lowest stable operating condition in the compressor (represented by the curves C or D)

It can be stated that well designed centrifugal compressors of intermediate pressure ratio (i.e. 2.5 to 1 to 5 to 1) with vaneless diffusers can have a stable operating range of 30%, whereas a centrifugal compressor of similar pressure ratio with some type of vaned diffuser is limited at best to a 20% stable operating range.

Many centrifugal compressor applications require part load characteristics, wherein the head or pressure ratio drops less fast than the flow rate. Curve A in FIG. 1, for example, represents a typical load line of a water cooled chiller. In practice, even better part load head capability is required for water cooled chillers since variations from the typical load line A are not uncommon. Curve B in FIG. 1, for example, is a typical load line of a water cooled chiller under variable capacity, constant-temperature-lift operating conditions.

Vaned diffuser centrifugal compressors with only variable inlet geometry, part-load control devices are not capable of providing the required head under off-design conditions. The limited range at full load also results in limited range under part load conditions. The end result is a steep surge line on the compressor performance map such as shown at line C in FIG. 1.

In contrast the performance map of a centrifugal compressor constructed in accordance with the present invention is shown in the curve D of FIG. 1. It will be recognized that, in addition to the high efficiency (i.e. in access of 85%) a very wide stable operating range (i.e. in access of 35%) is demonstrated. This surge line which exceeds the most severe load line condition demands (i.e. constant temperature lift water-cooled chiller operation), is obtained with fixed diffuser geometry and with only one variable geometry mechanism, i.e. the variable inlet guide vanes. The specific structure of a centrifugal compressor incorporating the present invention will now be described.

Figure 2:
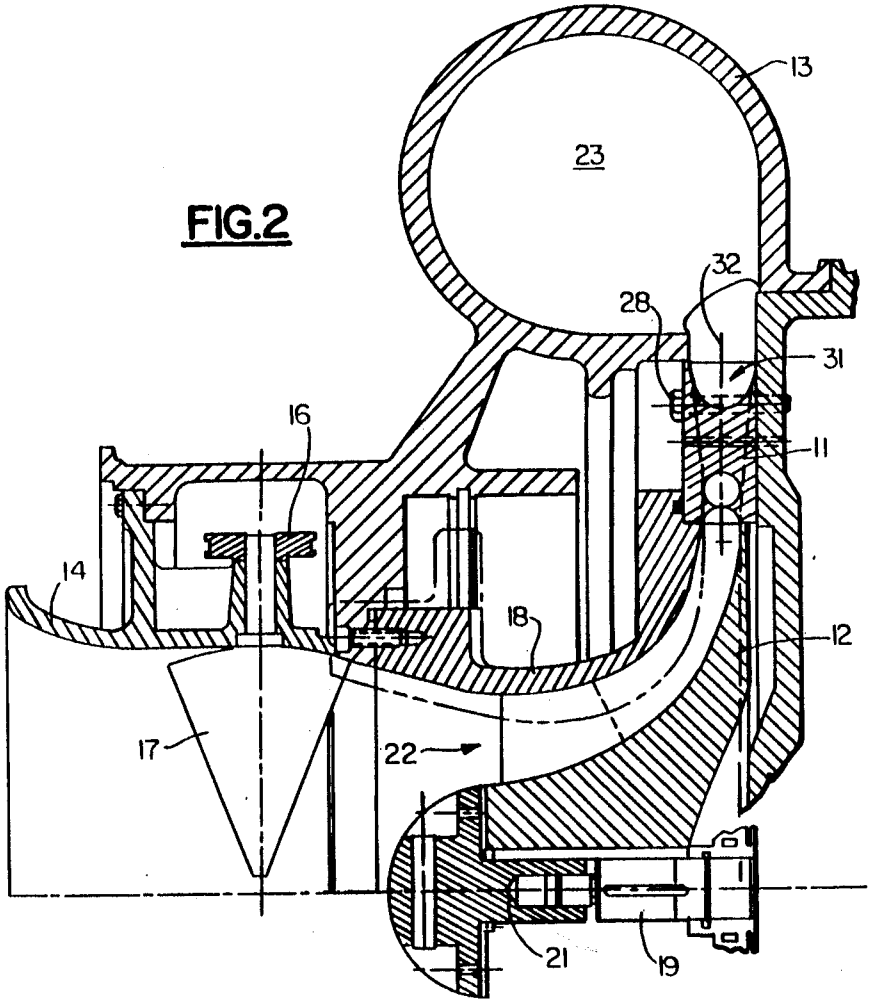
FIG. 2 is a partial, axial cross sectional view of a centrifugal compressor having the present invention incorporated therein.
Figure 3:
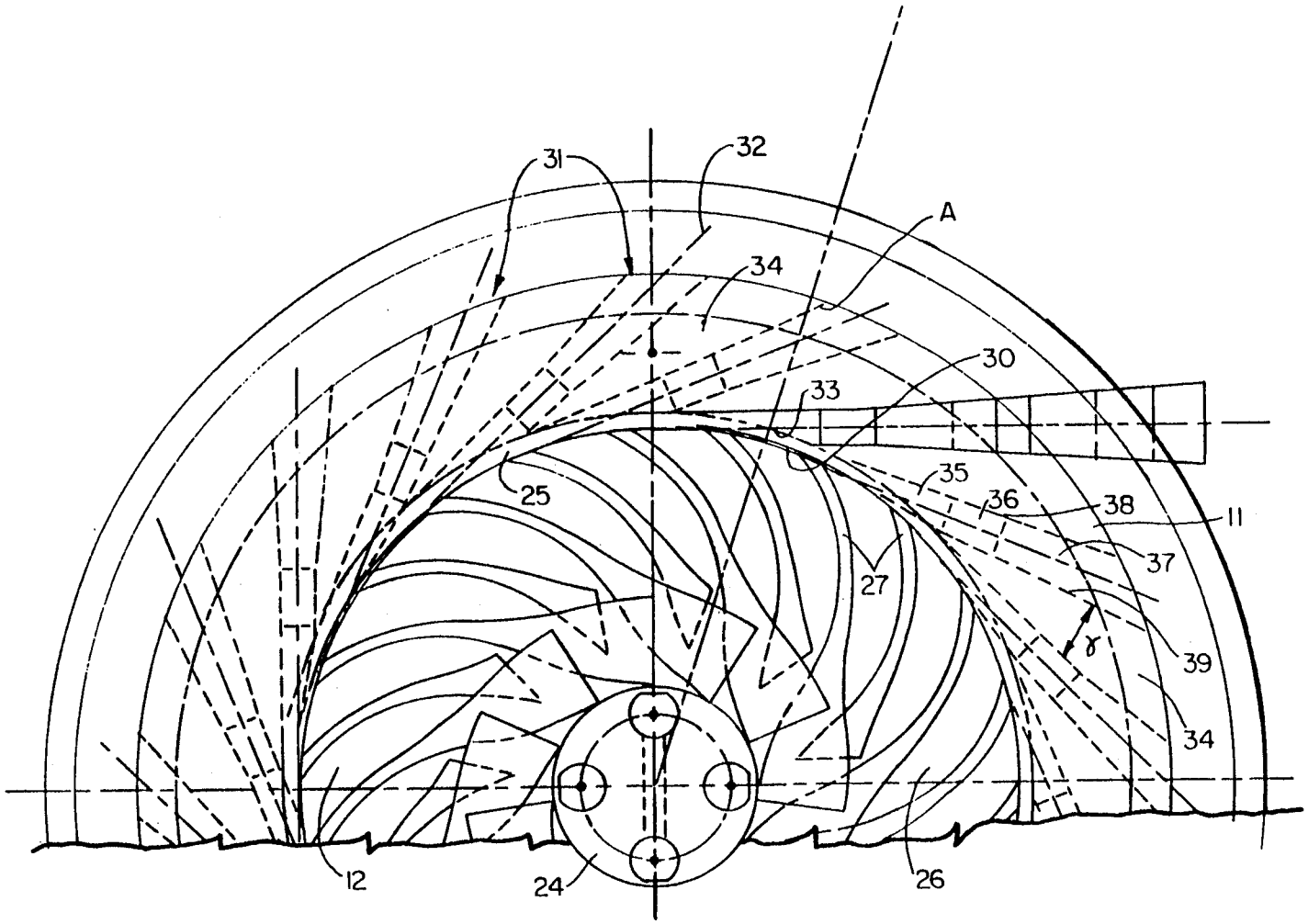
FIG. 3 is a radial view of the diffuser and impeller portions thereof.

Referring now to FIGS. 2 and 3, the invention is shown generally at 10 as comprising a particular configuration of a pipe diffuser 11 combined with an impeller 12, as installed in an otherwise conventional centrifugal compressor having a volute structure 13, suction housing 14, blade ring assembly 16, inlet guide vanes 17, and shroud 18. The impeller 12 is mounted on a drive shaft 19, along with a nose piece 21. When the assembly is rotated at high speed, it draws refrigerant into the suction housing 14, past the inlet guide vanes 17, and into the passage 22 where it is compressed by the impeller 12. It then passes through the diffuser 11, which functions to change to kinetic energy to pressure energy. The diffused refrigerant then passes into the cavity 23 of the volute 13, and then on to the cooler (not shown).

Referring now to FIG. 3, the impeller wheel 12 is shown in greater detail to include a hub 24, an integrally connected and radially extending disc 26, and a plurality of blades 27. It will be seen that the blades 27 are arranged in a so called backswept configuration which is a significant feature of one aspect of the present invention as will be more fully described hereinafter.

The pipe diffuser 11 is shown in its installed position in FIG. 2, and in combination with the impeller 12 only in FIG. 3. It comprises a single annular casting which is secured near its radially outer portion to the volute structure 13 by a plurality of bolts 28. A plurality of circumferentially spaced, generally radially extending, tapered channels 31 are formed in the diffuser 11, with their center lines 32 being tangent to a common circle indicated generally at 30 and commonly referred to as the tangency circle, which coincides with the periphery of the impeller 12.

A second circle, located just outside the tangency circle, is referred to as the leading edge circle and is indicated at 33 in FIG. 3. The leading edge circle, by definition, passes through the leading edges of each of the wedge shaped islands 34 between the channels 31. The radial space between the periphery of the impeller 12 and the leading edge circle 33 is a vaneless/semi vaneless space 25 whose radial depth is limited in accordance with the present invention in order to broaden the operating range of the system. That is, the applicant has found that, in order to prevent flow separation in the vaneless space 25, this radial dimension should be less than the throat diameter of the tapered channels 31. This vaneless/semi-vaneless space 25, which, for purposes of simplicity will be referred to as a "vaneless" space is more fully described in U.S. patent application Ser. No. 605,619 filed on Oct. 30, 1990, assigned to the assignee of the present invention, and incorporated herein by reference.

As will be seen in FIG. 3, each of the tapered channels 31 has three serially connected sections, all concentric with the axis 32, as indicated at 35, 36 and 37. The first section 35, which includes the "throat" mentioned above, is cylindrical in form, (i.e. with a constant diameter) and is angled in such a manner that a projection thereof would cross projections of similar sections on either circumferential side thereof. A second section indicated at 36 has a slightly flared axial profile with the walls 38 being angled outwardly at a angle with the axis 32. An angle that has been found to be suitable is 2°. The third section 37 has an axial profile which is flared even more with the walls 39 being angled at an angle which is on the order of 4°. Such a profile of increasing area toward the outer ends of the channel 31 is representative of the degree of diffusion which is caused in the diffuser 11 and is quantified by the equation $$\text{area ratio} = \frac{\text{area at exit of channel}}{\text{area at inlet of channel}}$$

wherein the area at the exit of the channel is taken normal to the axis at the location identified at A in FIG. 3.

It was seen in FIG. 3 that the formation of the tapered channels 31 results in the tapered sections or wedges 34 therebetween. It will also be evident that the more tapered channels 31 that are formed in the diffuser, the smaller will be the angle $\gamma$ of the wedges 34. The particular diffuser 11 shown in FIG. 3 has 16 tapered channels formed therein, such that the angle $\gamma$ is then equal to $22\frac{1}{2}°$. This relatively large wedge angle tends to prevent flow separation that might otherwise occur because of variations in impeller discharge flow angle $\beta_2$. As will be seen in the subsequent discussion of the impeller design and performance, it is desirable to provide for relatively tangential flow. This, in turn, tends to reduce the change in $\beta_2$ with mass flow rate variations. In general, it is therefore desirable to have a relatively large wedge angle $\gamma$ to accommodate variations in incidence. The number of tapered channels 31, however, must be sufficiently high so as to accommodate the flow volume from the impeller. The applicant has therefore determined that one can obtain high efficiency performance over a broad operating range, as is desirable for the present invention, by a pipe diffuser having a wedge angle, $\gamma$ as low as 15° (i.e. 24 tapered channels). We will return to the issue of leading edge separation after a discussion of the impeller design and characteristics.

Figure 5:
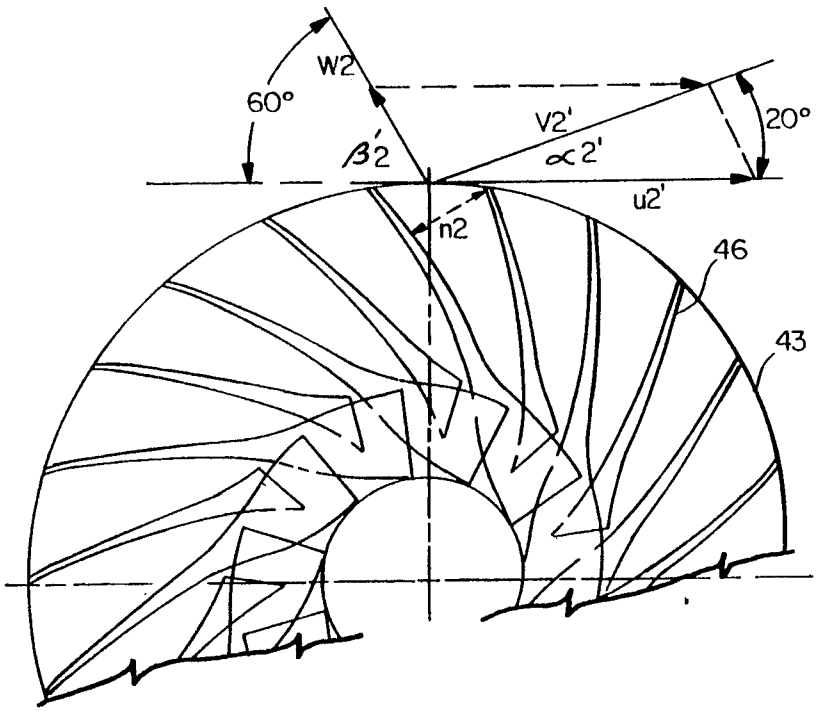
FIGS. 4 and 5 are radial views of the impeller of the present invention showing the effect of backsweep on the absolute flow exit angle $\alpha_2$.
Figure 4:
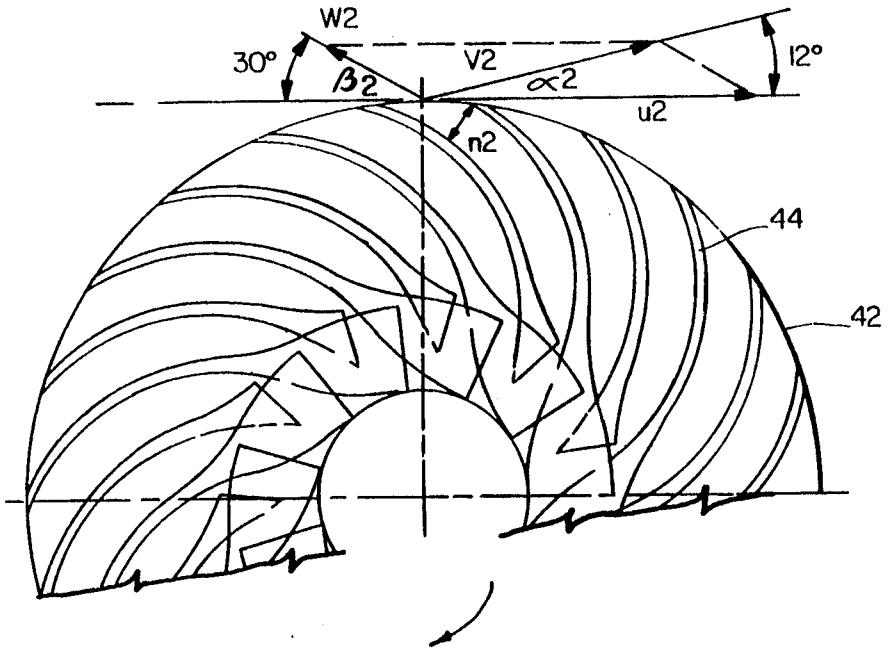

Referring now to FIGS. 4 and 5, there are shown impellers 2 and 43 having different degrees of backsweep. The impeller 42 has blades 44 with a 60° backsweep (i.e. an impeller discharge blade angle $\beta_2$ of 30°), and the impeller 43 has blades 46 with a 30° backsweep (i.e. an impeller discharge blade angle $\beta_2$ of 60°). The absolute tangential component of the flow leaving the impeller, $V_2\theta$ can be obtained by the equation $$V2\theta = W2\theta + U2$$

where

W2 = the tangential component of the relative velocity and

U2 = the propeller tip speed

For impellers with backsweep, the direction of the tangential component of the relative velocity, $W2\theta$, is opposite to the tip speed direction. For such impellers, $V2\theta$ becomes less than U2 and is reduced further by higher impeller backsweep angles. However, since the impeller tip speed U2 is several times larger than the total relative velocity at the impeller discharge W2, the relative change in $V2\theta$ due to impeller backsweep is much less than the relative change in radial velocity V2R caused by impeller backsweep. Because the increased backsweep reduces the absolute radial velocity V2R to a much larger extent than the absolute tangential velocity $V2\theta$, another effect of increased impeller discharge blade angle backsweep with constant shroud stream surface diffusion is a reduction in the absolute flow angle $\alpha_2$ leaving the impeller. It will therefore be seen in FIG. 4 that for a 60° backsweep, the impeller absolute flow exit angle $\alpha_2$ is 12°, and for a backsweep of 30° as shown in FIG. 5, the impeller absolute flow exit angle $\alpha_2=20°$.

Normally, neither the impeller 42 shown in FIG. 4 or impeller 43 shown in FIG. 5 would be acceptable for operation where a broad operating range is desired since the radial pressure gradients at the impeller periphery would tend to cause flow separation. However, when used with the pipe diffuser of the present invention, these lower absolute flow exit angles $\alpha_2$ are not only possible but, as discovered by the applicant, allow one to obtain higher efficiency over a relatively broad operating range.

Figure 6:
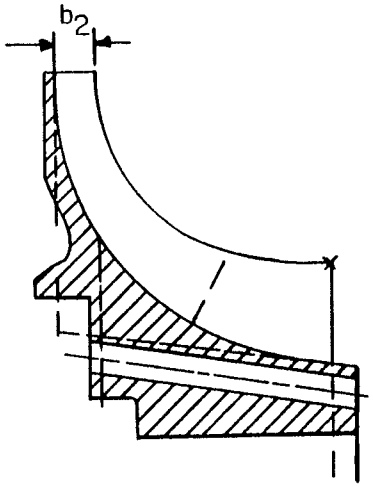
FIGS. 6 and 7 are axial cross sections of the blades showing the effect of impeller back sweep on the height $\beta_2$ of the impeller blades at discharge.
Figure 7:
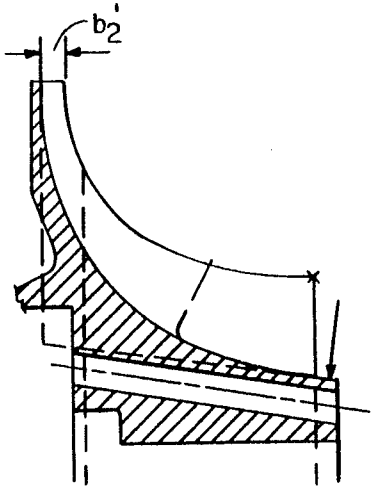

It will be recognized that in comparing the impellers of FIG. 4 and 5, an increase in the impeller backsweep reduces the blade to blade normal distance n2 of the discharge normal flow area as shown in FIGS. 6 and 7. That is, the high backsweep impeller of FIG. 4 with its attendant reduced blade to blade normal distance n2 requires a greater impeller discharge blade height $b_2$ than the impeller discharge blade height $b_2$ as shown in FIG. 7, which is associated with the lower backsweep impeller 43 of FIG. 5. If we assume that we want to maintain the relative velocity radio $W_2/W_1$, where $W_2$ is the relative impeller discharge velocity and $W_1$ is the relative impeller inlet shroud velocity, then an increase in impeller backsweep angle will therefore result in an increase in the impeller tip blade height $b_2$. This relatively wider tip impeller tends to provide stability at low flow conditions since it results in smaller absolute impeller discharge flow angles $\alpha_2$ which therefore will show smaller angle variations at reduced flow. Consequently, incidence effects will be less to thereby promote stability.

In summary, there are three features in the diffuser and impeller structures of the present invention which contribute to the high efficiency, broad operating range characteristics of the present invention. First, the number of tapered channels 31 is limited such that the wedge shaped islands 34 therebetween have a relatively large wedge angle $\gamma$ such that the occurrence of flow separation at the tips are minimized. Secondly, the vaneless space 25 between the outer periphery 30 of the impeller 31 and the leading edge circle 33 is limited in its radial depth such that the occurrence of flow instabilities are prevented. In this regard, the combination of the small vaneless space 25 together with the solidity of the wedges 34, create pressure fields inside the vaneless space with the gradients being more parallel with the direction of flow rather than creating radial gradients which would tend to cause flow separation. Finally, the use of an impeller with high backsweep, and therefore one with the wide tip impeller, a very shallow discharge flow angle, and relatively small absolute angle variations, reduces the sensitivity of the downstream component (i.e. diffuser) to variations in flow rate and thus increases the stable operating range of the compressor. These results are illustrated in FIGS. 8 and 9.

Figure 8:
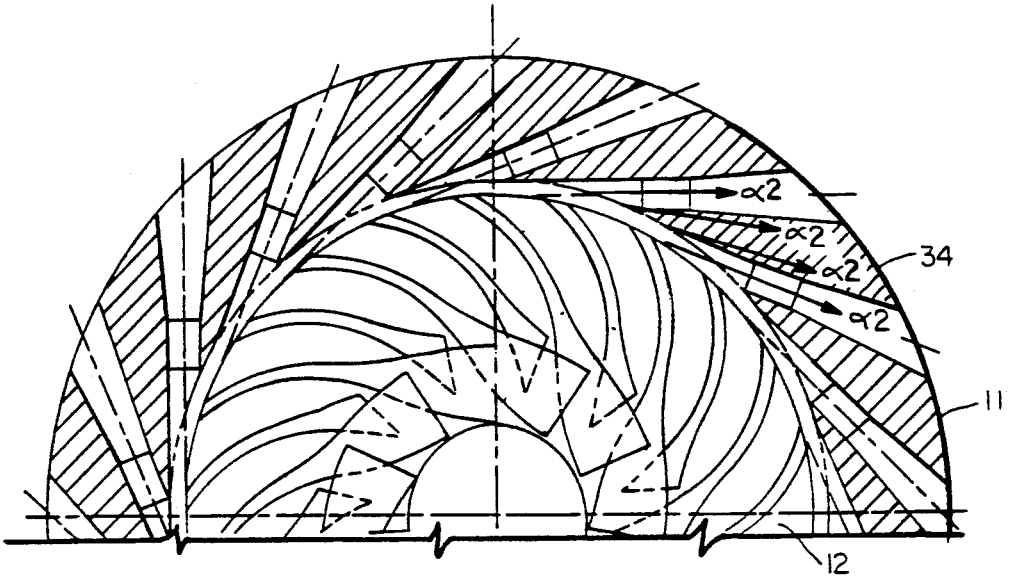
FIGS. 8, and 9 show the flexibility of the present invention in accommodating various flow rates without diffuser leading edge separation.
Figure 9:
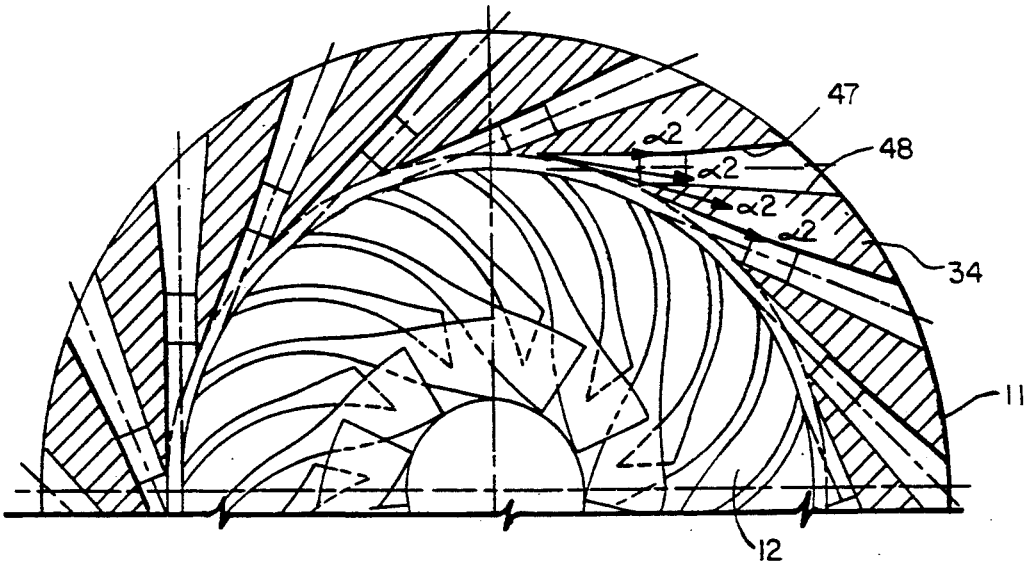

In both FIGS. 8 and 9, the pipe diffuser 11 and the impeller 12 are identical to that in FIG. 3, that is with a 60° backsweep in the impeller, with a vaneless space whose radial depth is less than the diameter of the tapered channel throat, and with a wedge angle of 22½°. When the flow is at the full design flow level, the absolute flow exit angle $\alpha_2$ in the flow direction is parallel to the center line of each of the tapered channels 31 of the diffuser 11. This is shown by the arrows in FIG. 8. It will be seen that the two intermediate arrows represent the direction of refrigerant flow as it engages the wedge 34 on its pressure and suction side. It will thus be understood from this illustration that no flow separation will occur at the tip of the wedge 34. The absolute flow exit angle $\alpha_2$ is 12° at this flow level.

Referring now to FIG. 9, the amount of flow is substantially reduced such that the absolute flow exit angle $\alpha_2$ is reduced to 2°. Here, the flow direction is parallel to the suction side, and there will of course be no flow separation. The two intermediate arrows again represent the direction of flow that will engage the wedge 34 on its suction side 48. Again, it will be seen that the angles are such that flow separation at the tip of the wedge 34 will not occur.

While the present invention has been disclosed with particular reference to a preferred embodiment, the concepts of this invention are readily adaptable to other embodiments, and those skilled in the art may vary the structure thereof without departing from the true spirit of the present invention.

What is claimed is:

1. An improved centrifugal compressor of the type having inlet guide vanes, an impeller and a diffuser and being adapted for operation over a substantial range of operating flow conditions, wherein:

said diffuser comprises a plurality of fixed wedge-shaped channels disposed circumferentially around and in close proximity to the outer periphery of said impeller, with each of said channels having a longitudinal center line which is aligned tangentially with said impeller outer periphery and which forms an angle with the longitudinal center lines of adjacent channels of at least 15 degrees; and said impeller comprises a plurality of blades disposed in a backswept orientation such that the fluid leaves the tips thereof at a flow exit angle of not more than 20 degrees.

2. An improved centrifugal compressor as set forth in claim 1 wherein said diffuser has at its inner periphery a vaneless space with a radial depth which is less than the smallest diameter within its wedge shaped channels.

3. An improved centrifugal compressor as set forth in claim 1 wherein said channels each comprise two serially connected sections, with the first section having diverging walls angled at one angle and the second section having diverging walls angled at a second larger angle.

4. An improved centrifugal compressor as set forth in claim 3 wherein the angle between the walls in the first section is 4 degrees and the angle between the walls in the second section is 8 degrees.

5. An improved centrifugal compressor as set forth in claim 1 wherein said channels are round in transverse cross section.

6. An improved centrifugal compressor as set forth in claim 5 wherein said channels are frustro-conical in longitudinal cross section.

7. An improved centrifugal compressor of the type having in serial flow combination, a variable geometry inlet, an impeller and a fixed geometry diffuser, wherein the improvement comprises:

an impeller having a plurality of circumferentially spaced blades for discharging fluid in a generally radial direction, said blades being so disposed as to impart motion to said fluid at a flow exit angle of less than 20 degrees; and a diffuser structure with a plurality of circumferentially spaced channels formed therein, said channels having center lines which extend substantially tangentially through the periphery of said impeller and the number of said channels being limited such that the angle between adjacent channel center lines is greater than 18 degrees.

8. An improved centrifugal compressor as set forth in claim 7 wherein said diffuser structure has at its inner periphery a vaneless space with a radial depth which is less than the smallest diameter within its circumferentially spaced channels.

9. An improved centrifugal compressor as set forth in claim 7 wherein channels are circular in cross-section.

10. An improved centrifugal compressor as set forth in claim 7 wherein channels are conical in longitudinal cross-section.

11. An improved centrifugal compressor as set forth in claim 7 wherein said impeller blades are formed in a backswept manner.

* * * * *